US012330855B2

(12) United States Patent
Wilson

(10) Patent No.: US 12,330,855 B2
(45) Date of Patent: Jun. 17, 2025

(54) STORAGE BAG HAVING AN INTEGRATED MANUAL PUMP

(71) Applicant: Jorel Wilson, Sterling Heights, MI (US)

(72) Inventor: Jorel Wilson, Sterling Heights, MI (US)

( * ) Notice: Subject to any disclaimer, the term of this patent is extended or adjusted under 35 U.S.C. 154(b) by 171 days.

(21) Appl. No.: 18/352,530

(22) Filed: Jul. 14, 2023

(65) Prior Publication Data

US 2024/0017902 A1 Jan. 18, 2024

Related U.S. Application Data

(60) Provisional application No. 63/389,916, filed on Jul. 17, 2022.

(51) Int. Cl.

| | |
|---|---|
| ***B65D 81/20*** | (2006.01) |
| ***B65D 30/24*** | (2006.01) |
| ***B65D 33/01*** | (2006.01) |
| ***B65D 33/25*** | (2006.01) |

(52) U.S. Cl.

CPC ..... *B65D 81/2038* (2013.01); *B65D 31/147* (2013.01); *B65D 33/2508* (2013.01)

(58) Field of Classification Search

CPC .. B65D 33/01; B65D 81/263; B65D 81/2038; F04B 9/14

See application file for complete search history.

(56) References Cited

U.S. PATENT DOCUMENTS

| | | | | |
|---|---|---|---|---|
| 3,129,835 A * | 4/1964 | Collens | F04B 43/0063 215/311 |
| 8,701,910 B1 * | 4/2014 | Michalopoulos | B65D 81/2038 417/478 |
| 9,630,763 B2 * | 4/2017 | Lituchy | B65D 81/20 |
| 2022/0089306 A1 * | 3/2022 | Chang | B65D 33/25 |

FOREIGN PATENT DOCUMENTS

KR 20100011121 U * 11/2010

* cited by examiner

*Primary Examiner* — Jes F Pascua
*Assistant Examiner* — Nina K Attel
(74) *Attorney, Agent, or Firm* — University of Michigan Law School

(57) ABSTRACT

A resealable bag having an integrated manual pump is provided. The resealable bag includes: a front wall and a back wall together defining a cavity, a sealable closure configured to seal an opening to the cavity, and a manual pump positioned within an aperture in the front wall, wherein the manual pump includes a frame around a perimeter of the aperture, a pump ball positioned within the frame, and an ingress valve and an egress valve in fluid communication with an interior of the pump ball. Air is removed from the bag by depressing the pump ball, which forces air through the egress valve from the interior of the pump ball to an exterior of the bag. The pump ball refills with air between depressions due to air from the bag cavity entering the pump ball through the ingress valve disposed on a cavity-facing surface of the pump ball.

20 Claims, 7 Drawing Sheets

STORAGE BAG HAVING AN INTEGRATED MANUAL PUMP

CROSS-REFERENCE TO RELATED APPLICATION

This application claims priority to U.S. Provisional Application 63/389,916 filed Jul. 17, 2022, which is hereby incorporated by reference in its entirety.

TECHNICAL FIELD

The disclosure is directed to a flexible wall storage container, and more specifically, to a sealable storage bag having an integrated air removal component.

DESCRIPTION OF THE RELATED ART

Airtight flexible wall storage containers, such as sealable storage bags, are used frequently in households and commercial settings, for the storage of perishable and non-perishable goods. It is often desirable to remove some of the air within the storage containers to achieve a reduced pressure environment (i.e., a partial vacuum). The partial vacuum causes a reduction in volume within the storage container, providing space saving benefits when storing goods. The reduced air environment may also extend the life of perishable goods.

Conventional vacuum sealers, which use a motorized pump to remove air and heat to seal a bag shut, are effective at removing air; however, they are loud and bulky, require access to an electrical outlet, may not be accessible to a user when the user needs it, and do not allow for sustainable reuse of a bag. Others have developed resealable plastic bags with an integrated one-way valve. While these bags are reusable, they still require a separate accessory, such as a vacuum cleaner, hand pump, or electric air pump to remove the air. Such accessories may be bulky or easy to misplace and may not be accessible to a user or practical to use at the time that the user wants to vacuum-seal a bag.

Accordingly, a need exists for a reusable storage bag that can achieve an internal environment having a reduced pressure without the use of any external devices or accessories.

SUMMARY

The disclosure relates to airtight flexible wall storage containers configured to achieve an internal reduced pressure without the use of any external devices or accessories. Specifically, the disclosure relates to a reusable storage bag having an air removal system integrated into the bag. Various embodiments of the reusable storage bags described herein include an integrated manual pump.

One aspect of the disclosure relates to a resealable storage bag that includes: a front wall having an aperture disposed therein; a back wall coupled to the front wall, wherein the front wall and the back wall together define a cavity; a sealable closure configured to connect a portion of the front wall to a portion of the back wall to seal the cavity; and a manual pump positioned within the aperture. The manual pump comprises: a frame positioned around a perimeter of the aperture, securely coupling the manual pump to the front wall; a filter coupled to the frame and extending across the aperture; a pump cover coupled to the frame and extending across the aperture, the pump cover positioned over the filter, wherein the frame, the filter, and the pump cover together define a space; a pump ball positioned within the space; and an ingress valve and an egress valve each in fluid communication with an interior of the pump ball.

The filter and the pump cover are positioned such that a filter surface is cavity-facing and a pump cover surface is exterior-facing. The filter is porous such that air may flow between a front face of the filter and a back face of the filter. The pump ball is depressible. In various embodiments, the ingress valve is disposed within a wall of the pump ball on a filter-facing surface. The ingress valve is a one-way air valve configured to allow air from the cavity to enter the pump ball. The egress valve is a one-way air valve configured to permit an expulsion of air from the pump ball out to an exterior of the resealable storage bag.

In some embodiments, the pump ball is coupled to the frame. In some embodiments, the frame is affixed to the front wall. In some embodiments, the manual pump is fixedly (i.e., non-removably) integrated into the front wall. In some embodiments, the front wall and the back wall are formed of plastic or silicone. In some embodiments, the front wall and the back wall are formed of polyethylene or polypropylene. In various embodiments, the front wall and the back wall are integrally connected along a right edge, a left edge, and a bottom edge, and the sealable closure is positioned near a top portion of the front wall and a top portion of the back wall. In various embodiments, the sealable closure is an airtight closure comprising a seal top recloseable closure or a slide seal recloseable closure.

Another aspect of the disclosure relates to a method of removing air from a resealable storage bag, such as the resealable storage bag described above or elsewhere herein. Removing air from the resealable storage bag may create a vacuum or a partial vacuum within the resealable storage bag. The method of removing air from the resealable storage bag includes the steps of: sealing the cavity of the resealable storage bag by connecting a portion of the front wall to a portion of the back wall with the sealable closure; and depressing the pump ball, wherein depressing the pump ball forces air to be expelled through the egress valve from the interior of the pump ball to an exterior of the resealable storage bag.

In some embodiments, sealing the cavity comprises pressing a front side and a back side of the sealable closure together or sliding a slider along a track on the resealable storage bag. In some embodiments, depressing the pump ball comprises pushing down on the pump cover. In various embodiments, depressing the pump ball is performed repeatedly to remove all or substantially all the air from the resealable storage bag. The pump ball refills with air between depressions due to air from the cavity entering the pump ball through the ingress valve. In some embodiments, the ingress valve is disposed within a wall of the pump ball on a filter-facing surface of the pump ball.

Figure 1:
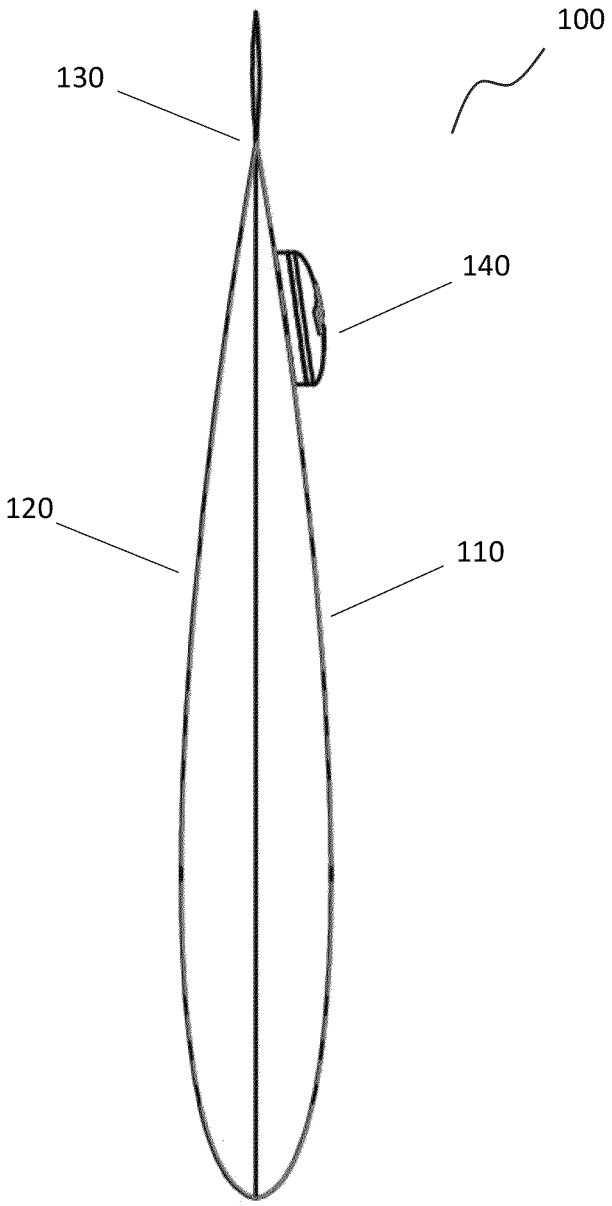
FIG. 1 depicts a side view of a storage bag having an integrated manual pump in accordance with one or more aspects of the present disclosure.

The aspects and embodiments depicted in the drawings and described below are intended to serve as examples and are not limiting. Various modifications and changes may be made without departing from the scope of the described technology.

DETAILED DESCRIPTION

An air-tight, resealable storage bag having an integrated manual pump and a method of removing air from such a bag are provided herein. Such a storage bag is configured to achieve a vacuum or partial vacuum within the storage bag without the use of any external devices or accessories.

As used herein, a "storage bag" shall refer to a flexible-walled, sealable container. The storage bag of the present disclosure may be any size, any shape, and any material suitable for storing perishable or non-perishable, solid or liquid, items. In some non-limiting examples, the storage bag is a "snack size" bag, a "sandwich size" bag, a quart sized bag, a gallon sized bag, or a larger bag. In some embodiments, the storage bag is formed of polyethylene, polypropylene, other plastics or a combination of plastics, metallocene or other composite, vinyl, or silicone.

As used herein, a "manual pump" shall refer to a manually manipulated air removal system.

As used herein, "integrated" shall refer to components that are integrally formed, glued, fused, melted, affixed, or otherwise connected together in a secure manner that is intended to be permanent (i.e., non-removable). Here, advantageously, the manual pump and the resealable bag are configured to be non-removably connected or formed together so that a user never needs to worry about misplacing the pump or not having it present or within reach at the time the user wishes to seal the storage bag.

As used herein, a "vacuum" or "partial vacuum" within a bag refers to a bag having a reduced internal pressure. The internal pressure may be reduced relative to a starting internal pressure and/or reduced relative to the atmospheric pressure external to the bag.

The resealable storage bag of various embodiments includes: a front wall and a back wall together defining a cavity, a sealable closure configured to seal an opening to the cavity, and a manual pump positioned within an aperture in the front wall. The manual pump includes: a frame around a perimeter of the aperture, a pump ball positioned within the frame, an ingress valve and an egress valve in fluid communication with an interior of the pump ball, and a pump cover coupled to the frame and extending across the aperture over the pump ball. The pump cover is configured to seal the aperture such that air does not leak into or out of the storage bag—except for the air traveling through the ingress and egress valves during actuation of the manual pump. In some embodiments, the storage bag further includes a filter extending across the aperture. The filter and the pump cover may be layered over each other such that a surface of the filter faces the cavity of the storage bag and a surface of the pump cover faces externally. The pump ball may be positioned between the filter and the pump cover.

A method of removing air from the storage bags described herein includes depressing the pump ball of the manual pump. Depressing the pump ball forces air to be expelled through the egress valve from an interior of the pump ball to an exterior of the resealable storage bag. The pump ball refills with air between depressions due to air from the cavity of the bag entering the interior of the pump ball through the ingress valve. The ingress valve may be disposed within or coupled to a wall of the pump ball and is positioned on a filter-facing and/or cavity-facing surface of the pump ball. In some embodiments, depressing the pump ball refers to pressing, squeezing, pinching, or otherwise actuating the pump ball. In some embodiments, repeated actuation of the pump ball causes all, substantially all, or a significant portion of the air to be removed from the storage bag.

Figure 2:
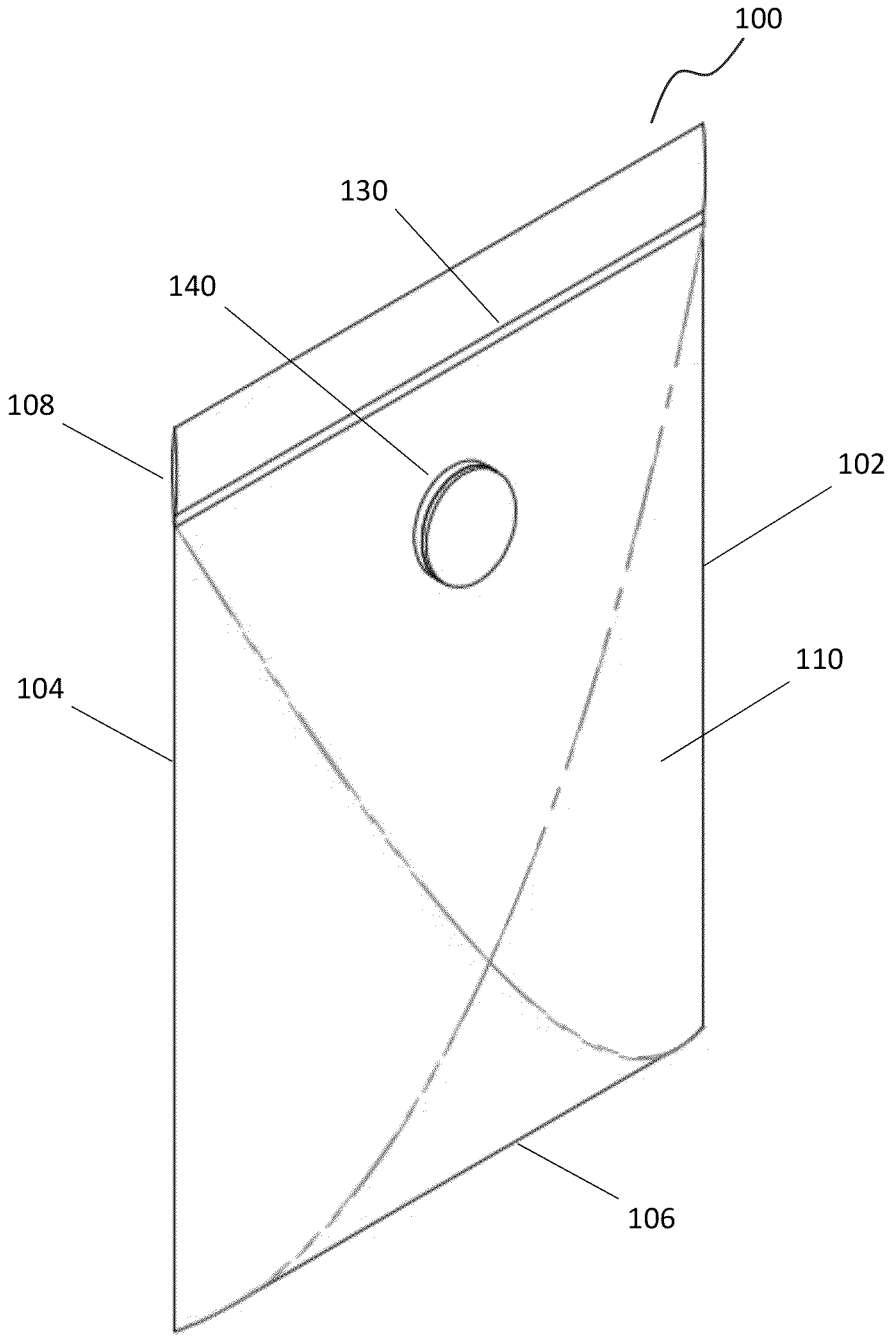
FIG. 2 depicts a front perspective view of a storage bag having an integrated manual pump in accordance with one or more aspects of the present disclosure.

Aspects of the disclosure are further exemplified in the accompanying figures. For example, as shown in FIG. 1 and FIG. 2, the resealable storage bag 100 is formed of a front wall 110, a back wall 120, a sealable closure 130, and an integrated manual pump 140.

The front wall 110 and the back wall 120 are connected along three edges (for example, a right edge 102, a left edge 104, and a bottom edge 106) and together define a cavity. In some embodiments, the front wall 110 and the back wall 120 are formed of two separate sheets, which are pressed, heat fused, adhesively bonded, or otherwise fused, bonded, or sealed together during the manufacturing process. In other embodiments, the front wall 110 and the back wall 120 are unitary, being formed integrally together during the manufacturing process. In still other embodiments, the front wall 110 and the back wall 120 are indirectly connected together along one or more of the three edges. For example, in some embodiments, the storage bag is gusseted, having a bottom wall and/or side walls, and the front wall 110 and the back wall 120 are each connected directly to the bottom wall and/or side walls.

Figure 3:
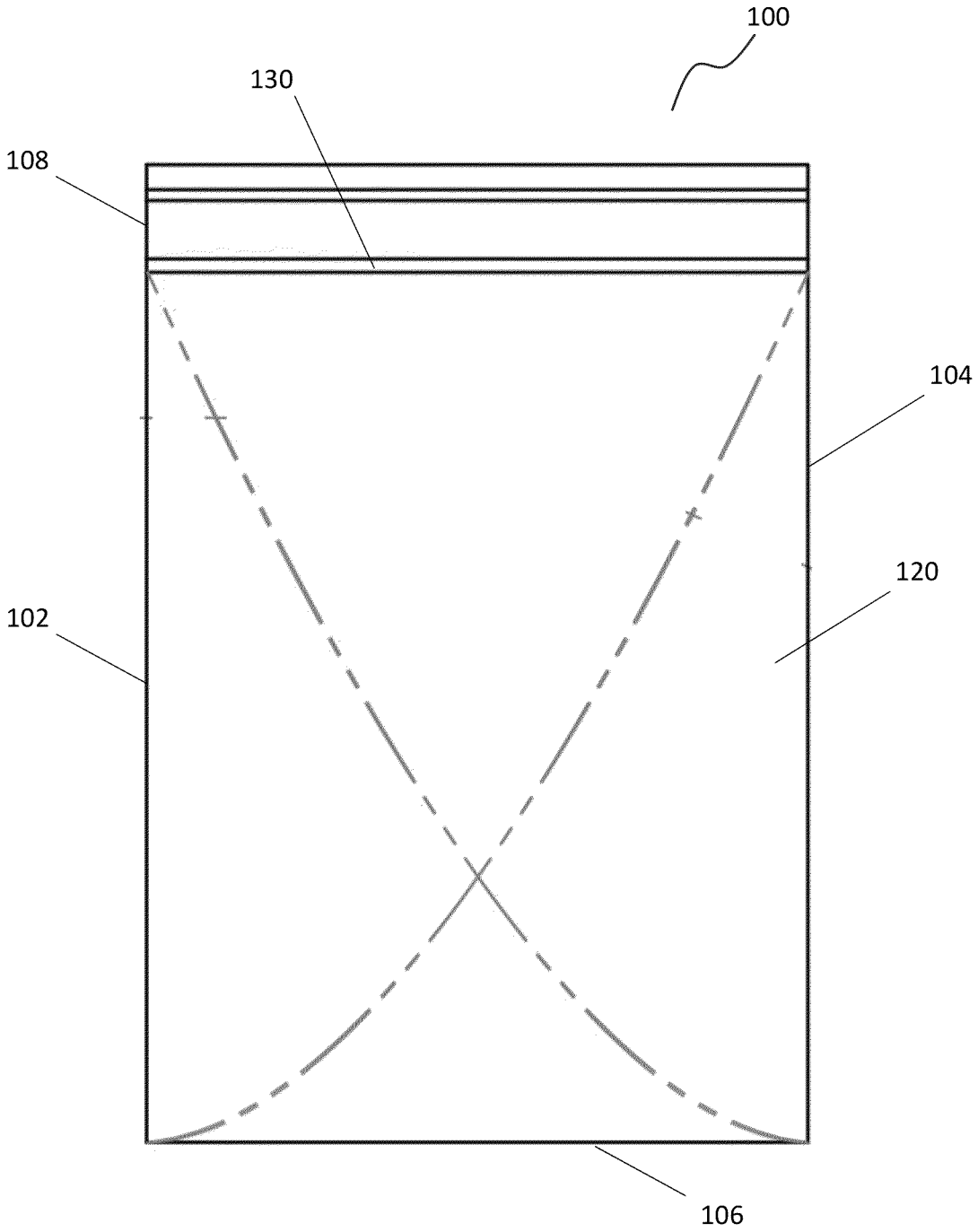
FIG. 3 depicts a back view of a storage bag having an integrated manual pump in accordance with one or more aspects of the present disclosure.

The storage bag 100 includes an opening on one end, for example, a top end, through which items can be inserted into or removed from the storage bag 100. A sealable closure 130 is positioned on a top portion 108 of the storage bag 100 and configured to form an airtight seal on or near the top end. The sealable closure 130 of various embodiments is resealable, allowing a user to selectively seal and unseal the bag to repeatedly open and close the bag, and reuse, as desired. The sealable closure 130 may be a seal top (also known as a zip track) recloseable closure (as shown, for example, in FIG. 2, FIG. 3, and FIG. 4), a slide seal (also known as a slider zipper) recloseable closure (as shown, for example, in FIG. 5 and FIG. 6), or any other resealable closure known to those skilled in the art.

Figure 4:
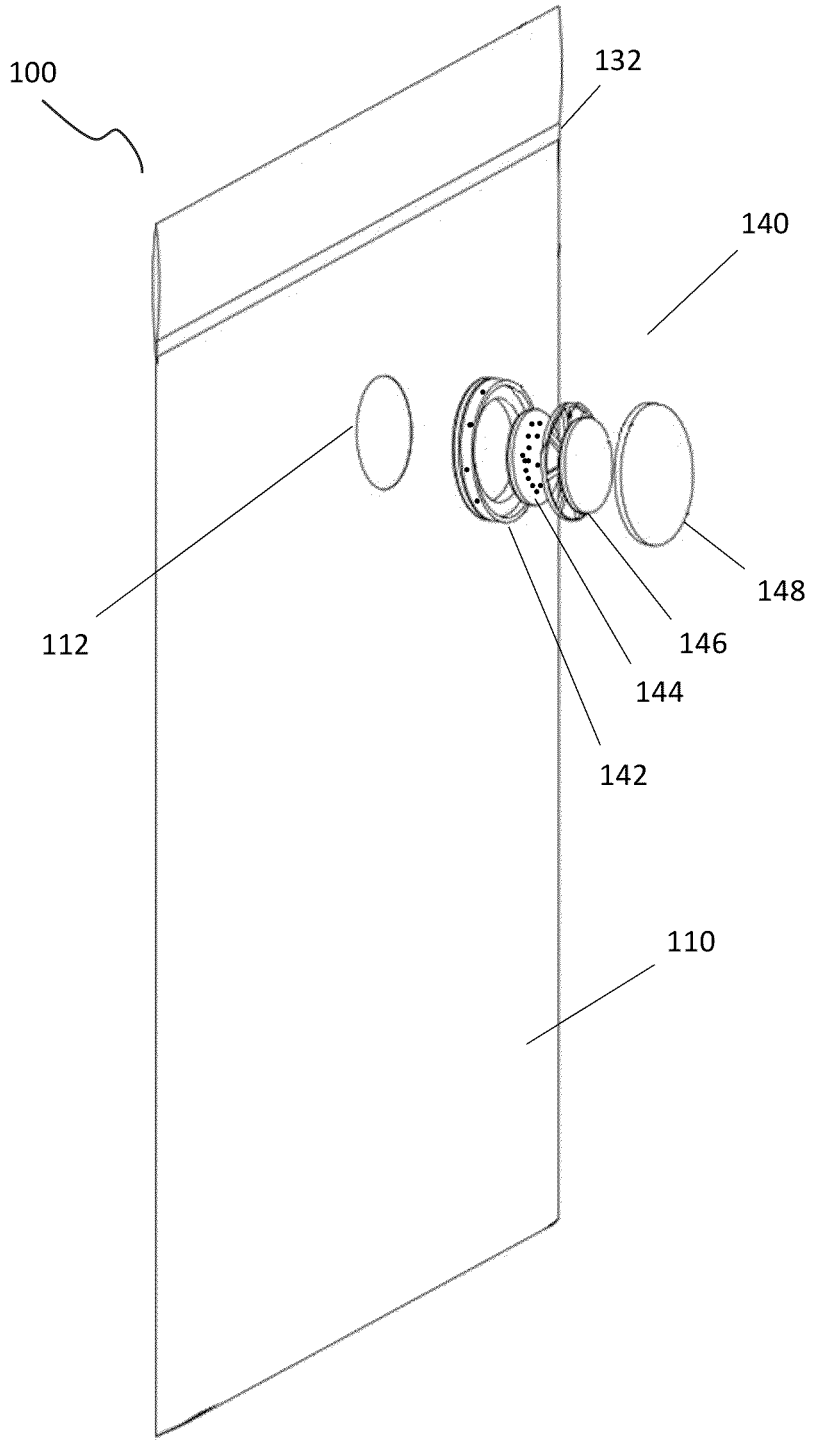
FIG. 4 depicts an exploded front perspective view of a storage bag having an integrated manual pump in accordance with one or more aspects of the present disclosure.

As shown in FIG. 4, the front wall 110 has an aperture 112 disposed therein. The aperture may be any size and shape suitable for placement of a manual pump 140. In some embodiments, the aperture 112 is a circle. In some embodiments, the aperture 112 has a diameter of 0.5 inches to 3 inches.

The integrated manual pump 140 is formed of a frame 142, a pump ball 146, and a pump cover 148. In some embodiments, the manual pump 140 also includes a filter 144. Each of the pump components may be formed of any suitable material known to those skilled in the art. For example, the components may be formed of polyethylene, polypropylene, polyvinylchloride, polystyrene, polycarbonate, polyester, other plastic, a composite, silicone, rubber, or other suitable material.

The frame 142 is positioned around a perimeter of the aperture 112 such that it lines a perimeter of the front wall 110 defining the aperture 112. The frame 142 is configured to securely couple the manual pump to the front wall 110. In some embodiments, the frame 142 is affixed to the front wall 110. The frame 142 may be heat fused, adhesively bonded, or otherwise fused, bonded, sealed or permanently affixed to the front wall 110 during the manufacturing process. In some embodiments, a front portion of the frame 142 and a back portion of the frame 142 may snap lock or otherwise lock together with a portion of the front wall 110 securely pinched between the two portions of the frame 142.

The pump ball 146 is positioned within the aperture 112 and surrounded along an x-y plane by the frame 142. The pump cover 148 is connected or otherwise coupled to the frame 142 and positioned to extend across the aperture 112 such that it covers the aperture 112 and the pump ball 146. In some embodiments, the filter 144 is also connected or otherwise coupled to the frame 142 and positioned to extend across the aperture 112 such that it covers the aperture 112 and is positioned under the pump ball 146. In such embodiments, the frame 142, the filter 144, and the pump cover 148 together define a space, and the pump ball 146 is positioned within the space. The filter 144 and the pump cover 148 are positioned such that a filter surface is cavity-facing and a pump cover surface is exterior-facing. The filter 144 is porous such that air may flow between a front surface of the filter 144 and a back surface of the filter 144. In some embodiments, the pores of the filter 144 are sufficiently large to allow air to move easily through the filter 144 yet sufficiently small to block all, substantially all, most, or some dust and/or other particles from passing through the filter 144.

Figure 8:
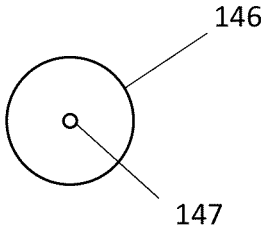
FIG. 8 depicts a back view of a pump ball in accordance with one or more aspects of the present disclosure.
Figure 9:
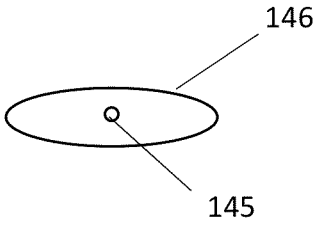
FIG. 9 depicts a side view of a pump ball in accordance with one or more aspects of the present disclosure.

In various embodiments, one or more ingress valves 147 (shown in FIG. 8) are disposed within or coupled to a wall of the pump ball 146 on a filter-facing surface. The one or more ingress valves 147 are in fluid communication with an interior of the pump ball 146. Each ingress valve 147 is a one-way air valve configured to allow air from the cavity to enter the pump ball 146. One or more egress valves 145 (shown in FIG. 9) are also disposed within or coupled to a wall of the pump ball 146. The one or more egress valves 145 are in fluid communication with an interior of the pump ball 146. Each egress valve 145 is a one-way air valve configured and positioned to permit an expulsion of air from the pump ball 146 out to an exterior of the resealable storage bag 100. In various embodiments, each of the ingress valves 147 and egress valves 145 is a swing check valve, a spring check valve, a ball check valve, a butterfly check valve, other check valve, or any other suitable one-way valve known to those skilled in the art.

Figure 5:
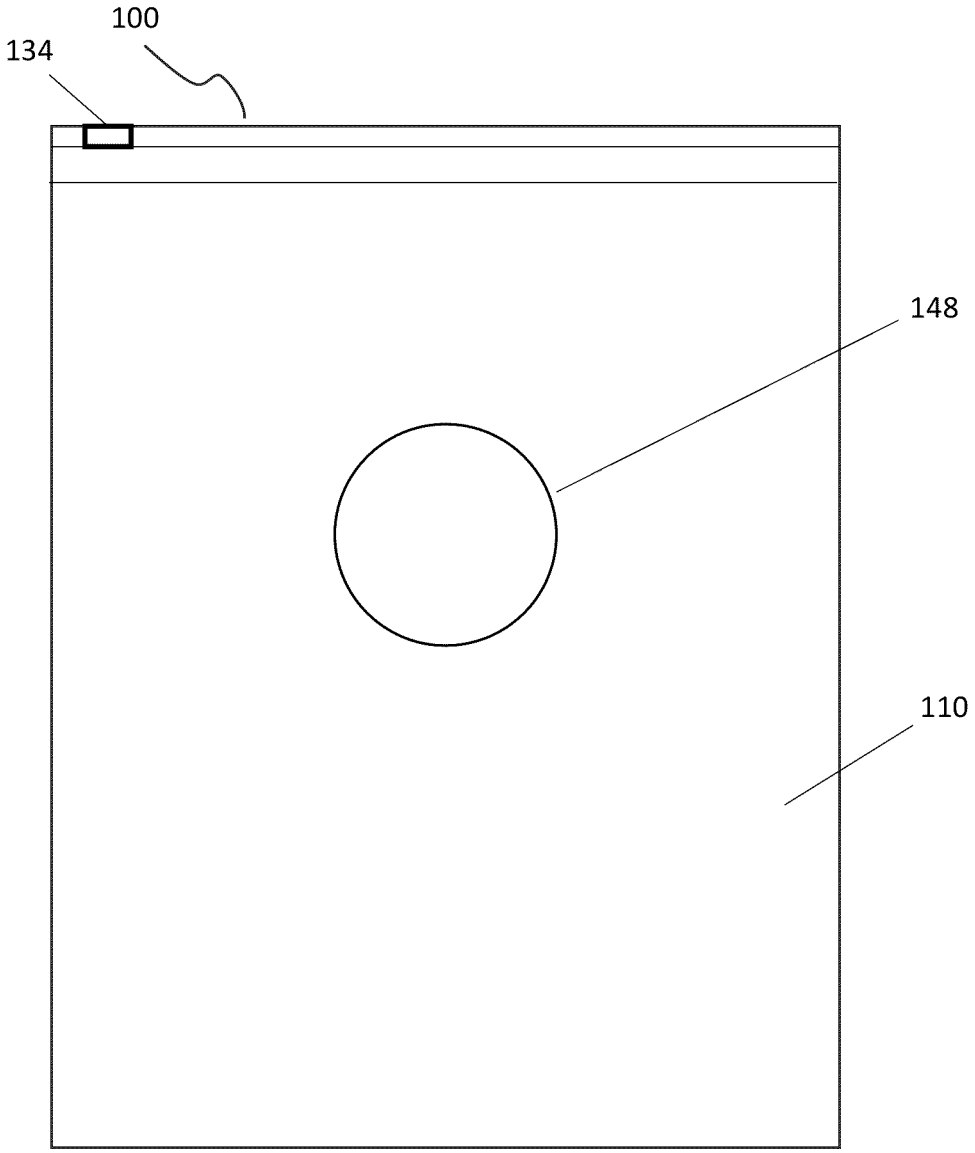
FIG. 5 depicts a front view of a storage bag having an integrated manual pump in accordance with one or more aspects of the present disclosure.
Figure 6:
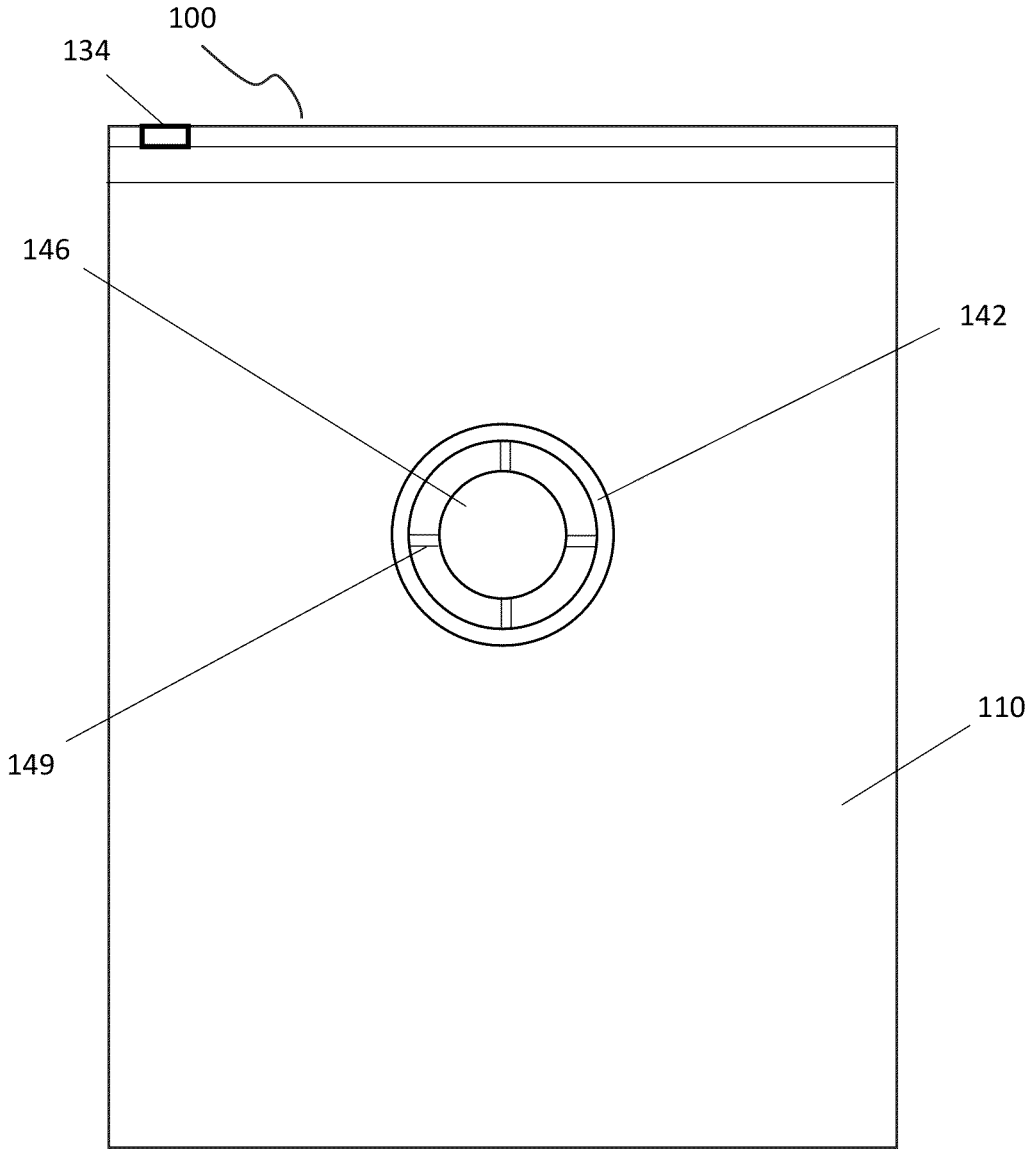
FIG. 6 depicts a front view of the storage bag of FIG. 5 with a pump cover removed.

An example resealable storage bag 100 having an integrated pump 140 is shown in FIG. 5. When viewed from the front, the pump cover 148 of the manual pump 140 is visible. While the pump cover 148 of various embodiments is intended to be non-removably affixed to the frame 142, FIG. 6 depicts the storage bag of FIG. 5 with the pump cover 148 removed, for illustrative purposes. As shown, in various embodiments, the pump ball 146 and the frame 142 are positioned underneath the pump cover 148.

In some embodiments, the pump ball 146 is not fixedly attached to other pump components but remains in the same general position due to having its movement restricted by the positions of the frame 142, the filter 144, and the pump cover 148. In such embodiments, the pump ball 146 is sandwiched between the filter 144 and the pump cover 148 along one plane and surrounded by the frame 142 on another plane.

In other embodiments, as shown for example, in FIG. 6, one or more struts 149 connect the pump ball 146 to the frame 142. In some such embodiments, the struts 149 are cannular, having a hollow lumen. The struts 149 are positioned and configured to connect the one or more egress valves 145 of the pump ball 146 to one or more air holes 143 in the frame 142.

Figure 7:
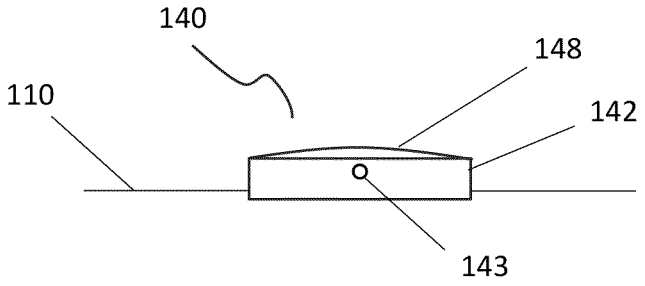
FIG. 7 depicts a side view of a manual pump integrated into a storage bag in accordance with one or more aspects of the present disclosure.

In various embodiments, one or more pores, holes, or openings 143 are present in the frame 142 and/or the pump cover 148 to allow air expelled from the egress valve 145 to exit the manual pump 140 to an exterior of the storage bag 100. Such air holes 143 in the side of the frame 142 are most visible in FIG. 7.

Unless otherwise defined, each technical or scientific term used herein has the same meaning as commonly understood by one of ordinary skill in the relevant art.

As used in the specification and claims, the singular form "a", "an" and "the" include both singular and plural references unless the context clearly dictates otherwise. For example, the term "an egress valve" is contemplated to include a plurality of egress valves. At times, the claims and disclosure may include terms such as "a plurality," "one or more," or "at least one;" however, the absence of such terms is not intended to mean, and should not be interpreted to mean, that a plurality is not conceived.

As used in the specification and claims, the term "comprising" or "comprises" is intended to mean that the devices, systems, and methods include the recited elements and may additionally include any other elements. Terms such as "including" and "having" are intended to be open terms synonymous with "comprising" and should be interpreted to respectively mean, for example, "including but not limited to" and "having at least."

The foregoing has included detailed descriptions of some features of the technology. Features of the various embodiments can be arranged, combined, and designed in a variety of different configurations, all of which are explicitly contemplated and form part of this disclosure. For example, any of the components described or depicted in one embodiment may be combined or interchanged with components, or excluded, from other embodiments. In light of the provided illustrations and examples, it will be readily apparent to those of ordinary skill in the art that numerous changes and modifications may be made without departing from the spirit or scope of the appended claims.

The invention claimed is:

1. A resealable storage bag, comprising:

a front wall having an aperture disposed therein;

a back wall coupled to the front wall, wherein the front wall and the back wall together define a cavity;

a sealable closure configured to connect a portion of the front wall to a portion of the back wall to seal the cavity; and a manual pump positioned within the aperture, wherein the manual pump comprises:

a frame positioned around a perimeter of the aperture, securely coupling the manual pump to the front wall, a filter coupled to the frame and extending across the aperture, a pump cover coupled to the frame and extending across the aperture, the pump cover positioned over the filter, wherein the frame, the filter, and the pump cover together define a space, a pump ball positioned within the space, and an ingress valve and an egress valve in fluid communication with an interior of the pump ball.

2. The resealable storage bag of claim 1, wherein the filter and the pump cover are positioned such that a filter surface is cavity-facing and a pump cover surface is exterior-facing.

3. The resealable storage bag of claim 1, wherein the filter is porous.

4. The resealable storage bag of claim 1, wherein the pump ball is depressible.

5. The resealable storage bag of claim 1, wherein the ingress valve is disposed within a wall of the pump ball on a filter-facing surface, the ingress valve being configured to allow air to enter the pump ball from the cavity.

6. The resealable storage bag of claim 5, wherein the ingress valve is a one-way air valve.

7. The resealable storage bag of claim 1, wherein the egress valve is a one-way air valve configured to permit an expulsion of air from the pump ball out to an exterior of the resealable storage bag.

8. The resealable storage bag of claim 1, wherein the pump ball is coupled to the frame.

9. The resealable storage bag of claim 1, wherein the frame is affixed to the front wall.

10. The resealable storage bag of claim 1, wherein the manual pump is non-removably integrated into the front wall.

11. The resealable storage bag of claim 1, wherein the front wall and the back wall are formed of plastic or silicone.

12. The resealable storage bag of claim 11, wherein the front wall and the back wall are formed of polyethylene or polypropylene.

13. The resealable storage bag of claim 1, wherein the front wall and the back wall are integrally connected along a right edge, a left edge, and a bottom edge, and wherein the sealable closure is positioned near a top portion of the front wall and a top portion of the back wall.

14. The resealable storage bag of claim 1, wherein the sealable closure is an airtight closure comprising a seal top recloseable closure or a slide seal recloseable closure.

15. A method of removing air from the resealable storage bag of claim 1, comprising:

sealing the cavity by connecting the portion of the front wall to the portion of the back wall with the sealable closure; and depressing the pump ball, wherein depressing the pump ball forces air to be expelled through the egress valve from the interior of the pump ball to an exterior of the resealable storage bag.

16. The method of claim 15, wherein sealing the cavity comprises pressing a front side and a back side of the sealable closure together or sliding a slider along a track on the resealable storage bag.

17. The method of claim 15, wherein depressing the pump ball comprises pushing down on the pump cover.

18. The method of claim 15, wherein depressing the pump ball is performed repeatedly to remove substantially all the air from the resealable storage bag.

19. The method of claim 18, wherein the pump ball refills with air between depressions due to air from the cavity entering the pump ball through the ingress valve, wherein the ingress valve is disposed within a wall of the pump ball on a filter-facing surface of the pump ball.

20. The method of claim 15, wherein removing air from the resealable storage bag creates a vacuum or a partial vacuum within the resealable storage bag.

* * * * *